United States Patent [19]

Ely

[11] Patent Number: 4,485,567

[45] Date of Patent: Dec. 4, 1984

[54] DRYER FELT RUN

[75] Inventor: Donald A. Ely, Roscoe, Ill.

[73] Assignee: Beloit Corporation, Beloit, Wis.

[21] Appl. No.: 426,609

[22] Filed: Sep. 29, 1982

[51] Int. Cl.[3] ..... F26B 13/08

[52] U.S. Cl. ..... 34/115; 34/114; 34/116; 34/123

[58] Field of Search ..... 34/116, 117, 120, 123, 34/111, 115

[56] References Cited

U.S. PATENT DOCUMENTS

| | | | |
|---|---|---|---|
| 3,011,544 | 12/1961 | Lippke | 34/117 |
| 3,250,019 | 5/1966 | Beachler | 34/117 |
| 3,751,822 | 8/1973 | Crist | 34/116 |
| 3,753,298 | 8/1973 | Ely | 34/116 |
| 4,172,007 | 10/1979 | Kankaanpaa | 162/206 |

*Primary Examiner*—Larry I. Schwartz

*Attorney, Agent, or Firm*—Hill, Van Santen, Steadman & Simpson

[57] ABSTRACT

A web dryer structure for thermal removal of moisture from a traveling web such as a web of paper coming from the press section of a papermaking machine including a row of upper dryer drums and a row of lower dryer drums with the drums positioned to carry the web in a sinuous path successively between upper and lower drums and the web wrapping the upper and lower surfaces of the drums respectively with upper and lower looped felts wrapping the web on the upper and lower surfaces of the drums with the felt guided by guide rolls which for the upper felt are beneath upper drums and for the lower felts are above lower drums with the guide rolls being hollow roll shells and having glands therein divided so that a first portion of the guide roll faces the onrunning web and a second portion faces the offrunning web with vacuum means and pressure means connected to the interior of the guide rolls so that one portion is subjected to a vacuum, and the other portion is subjected to a pressure, and the arrangement accommodates running the web in either direction.

8 Claims, 4 Drawing Figures

DRYER FELT RUN

BACKGROUND OF THE INVENTION

The invention relates to improvements in dryer drum structures for drying a traveling web, and more particularly to a structure which is used for thermally drying a web such as a continuous run of paper which is received at high speed from the press section of a papermaking machine.

More particularly, the invention relates to a particular arrangement and guidance of the web and felts which are threaded over the dryer drums with means for subjecting the web and the zones between felt guide rolls and the drums alternately to a vacuum and a pressure for improved control of the web and improved removal of moisture to enhance the operation of the dryer.

In the dryer section of a thermal dryer such as for a paper machine, the moisture carrying web is received from the press section of the machine and is directed along a serpentine path in wrapped relation with a plurality of steam heated dryer drums. These drums are usually arranged in upper and lower rows with the drums staggered so that the paper web can pass back and forth in a serpentine path and wrap the upper and lower drums with the moisture evaporating from the web as it is heated while in contact with the drum. To aid in the heat transfer from the drum to the web and to support the web in travel between the drums, upper and lower looped felts are provided which wrap the outer surface of the web while on the drum surface.

In relatively high speed papermaking machines, disadvantages have been encountered that the web is not fully controlled in transfer between the upper and lower felts and is sometimes lost at the point of transfer. Further, other disadvantages are encountered in that moisture which is removed by heating is not carried away as fast as possible in the areas between the drums.

It is accordingly an object of the present invention to provide an improved dryer section arrangement which improves the handling and transfer of the web and which also improves the removal of moisture therefrom. This objective generally is desired and sought after because with the increase in speed of papermaking machines, it is necessary for the dryer section to be able to accommodate such increase in speed.

A further object of the invention is to provide a web handling arrangement for a dryer section of a papermaking machine which achieves and accommodates more uniform drying across the width of the sheet and which helps avoid the complications of buildup of air pressure and buildup of moisture in the pockets formed between the felts, the dryer drums, and the guide rolls for the felts.

A feature of the invention is the provision of guide rolls for the felts which are constructed as perforated roll shells with glands within the roll shells that divide the areas into a pressure and vacuum chamber so that the web is alternately subjected to vacuum and pressure as it travels over the roll. A particular feature of the invention is the arrangement whereby the concepts of the inventions can be employed in a dryer drum wherein the web runs in either direction. That is, the same construction can be utilized with one arrangement as a mirror image of the other so that in one arrangement, the web is first subjected to a vaccum and then to pressure, and in the other arrangement, first subjected a pressure and then to a vacuum. This unique arrangement has been discovered to avoid damages in web handling and drying in both arrangements and to substantially facilitate reduction in costs in manufacture and assembly of the dryer arrangement and permit variations to be employed on the site of the papermaker without the requirement of the addition of more expensive parts or expensive and time consuming alteration and reconstruction.

Other objects and advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
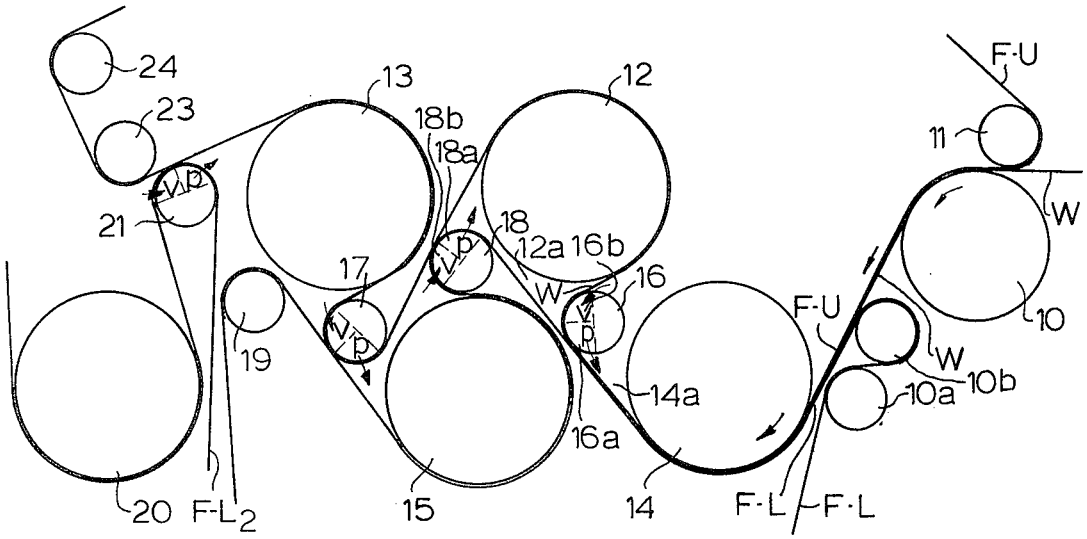
FIG. 1 is a somewhat schematic side elevational view of a dryer section of a papermaking machine constructed and arranged to embody the principles of the present invention.

As illustrated in FIG. 1, a web W is received from a press section, not shown, in a papermaking machine to pass into a dryer section shown in the FIG. 1. As the web W passes over a roll 10, it is received by an upper felt F-U threaded down onto the web over a roll 11. The web then becomes sandwiched between the upper felt F-U and a lower felt F-L guided up beneath the web over rolls 10*a* and 10*b*.

In the dryer section, the web is threaded over dryer drums carried by the felts F-U and F-L, and the felts are threaded to wrap the web on the drums by guide rolls.

Generally the dryer drums are steam heated cylindrical stainless steel drums as will be known to those versed in the art, arranged in an upper row as illustrated by the drums 12 and 13 and arranged in a lower row as illustrated by the drums 14 and 15.

The upper felt F-U is threaded over upper guide rolls such as 16 and 17 which are positioned beneath the upper drums 12 and 13 respectively. The lower felt F-L is guided over lower guide rolls such as 18 and 19 with the guide roll positioned above the lower drum 15. In the construction embodying the principles of the present invention, each of the guide rolls are constructed as hollow roll shells with glands within the shells so that a portion can be subjectd to a vacuum and a portion subjected to pressure as will be described in further detail in connection with FIGS. 3 and 4. As illustrated therein, the hollow roll shells 45 are supported on end bearings 46 to be either driven in rotation or to rotate due to frictional contact with the felts. The hollow roll shells are perforate having openings 47 therethrough so as to expose the felt and the web carried on the surface to the pressure or vacuum within the guide roll.

Figure 4:
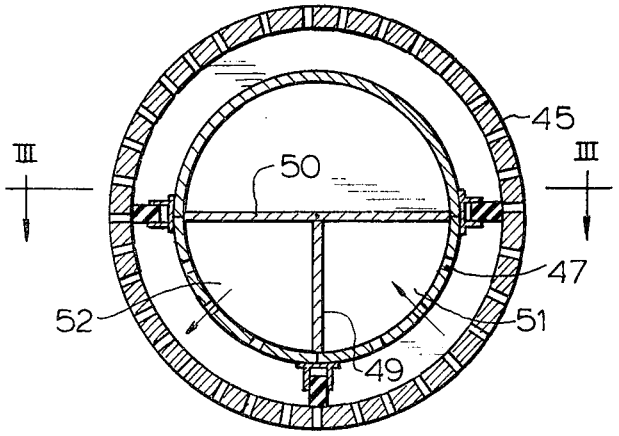
FIG. 4 is a sectional view taken generally along line IV—IV of FIG. 3.

As illustrated in FIG. 4, a gland or gland walls 49 and 50 are positioned within the hollow rolls shell to divide the roll shell into first and second portions, with one portion being subjected to a vacuum, and the other portion being subjected to a pressure. As illustrated in FIG. 4, the portion 51 is subjected to a vacuum, and the portion 52 subjected to a pressure, and the arrowed lines in FIG. 4 illustrates the direction of flow of air relative to the roll shell.

Figure 3:
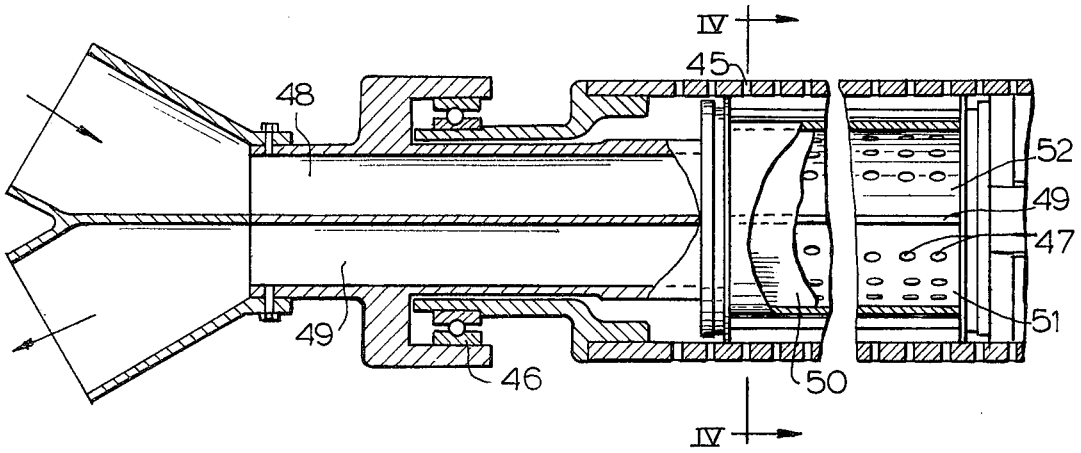
FIG. 3 is a sectional view taken through a guide roll generally along line III—III of FIG. 4.

As illustrated in FIG. 3, a conduit 48 connects to the portion 52 to pressurize that portion. Similarly, a conduit 49 connects to a vacuum to subject the portion 51 to a vacuum. Suitable pressure and vacuum means are provided shown schematically by the arrowed lines in FIG. 3, and pumps or fans of known construction will be arranged to provide the pressure and vacuum.

Returning to the arrangement shown in FIG. 1, as the web travels over the lower dryer drum 14 carried between the two felts F-U and F-L, it is first subjected to a pressure in the portion 16*a* of the guide roll 16. As it leaves the guide roll, it is subjected to a vacuum in the portion 16*b* of the guide roll. The glands within the guide rolls are arranged so that the web on its onrunning side is subjected to a pressure and on the offrunning side, is subjected to a vacuum. The pressure on the onrunning side helps force a flow of air through the felts and web aided by the air carried along on the upper surface of the felt which is trapped on the onrunning side of the felt and forced through the felt and web by the pressure in the portion 16*a*. The pressure will also cause a flow into the area on the onrunning side which helps carry away the moisture vapor which is present in the zone 14*a* following the drum 14. Suitable moisture removal vents, not shown, may be provided at the ends of the pockets or zones 14*a*.

The vacuum in the portion 16*b* of the guide roll helps transfer the web onto the upper felt F-U on the offrunning side of the guide roll. Also, there is some air transfer through the web and upper felt to aid in the drying process, and this helps evacuate the zone or pocket 12*a* ahead of the upper dryer drum 12.

As the web is carried over the upper dryer drum and onto the guide roll 18, it is first met with pressure from the portion 18. It is next subject to a vacuum on the offrunning side as it is exposed to the portion 18*b* of the guide roll 18. This aids in transfer of the web to the lower felt F-L which carries the web down over the lower dryer drum 15. The web is next carried onto the guide roll 17 where it is first subject to pressure on the onrunning side and then subject to a vacuum on the offrunning side to transfer it to the upper felt F-U to be carried up over the upper dryer drum 13. Following the upper dryer drum, the web and upper felt pass over the guide roll 21 whereupon the web is transferred to a second lower felt F-L2 to be carried down over the surface of a lower dryer drum 20. The upper felt is guided away over rolls 23 and 24.

Figure 2:
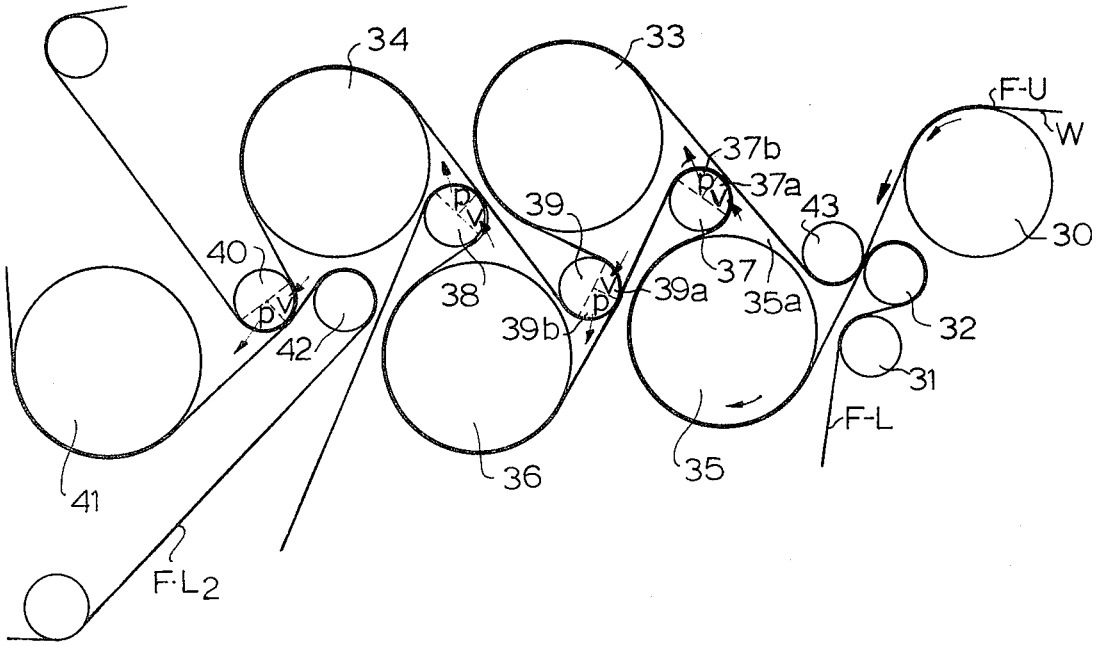
FIG. 2 is another somewhat schematic elevational view similar to FIG. 1, but showing an alternate arrangement.

In the construction of FIG. 2, essentially the same structural elements are employed, but the travel of the web, or in other words, the effect thereon is reversed with the web first being subjected to a vacuum and subsequently to a pressure as it travels over each guide roll. In other words, in the arrangement of FIG. 1, the webs sees in sequence a pressure and then a vacuum as it travels over the guide rolls, and in the arrangement of FIG. 2, the web sees a vacuum and then a pressure as it travels over the guide rolls. The web is subjected to advantageous treatment in each arrangement with the same construction being used. The papermaker can attain the desired arrangement by merely reversing the pressure and vacuum lines, or a valving arrangement may be used for rapid interchange of these lines.

In the arrangement of FIG. 2, a web W enters a dryer section carried on an upper felt F-U over a roll 30. It is then sandwiched between the felt F-U and a lower felt F-L which is carried up beneath the web over rolls 31 and 32. The upper felt is led away from the web on a roll 43.

The web is carried down over a lower dryer drum 35 on the lower felt F-L. The dryer section is arranged very similar to the arrangement in FIG. 1 with a lower row of drums 35 and 36, and an upper row of drums 33 and 34. The lower drums receive the lower felt F-L which is guided by lower felt guide rolls 37 and 38 which are positioned over the lower drums 35 and 36 respectively, and are positioned essentially between the upper drums.

The upper felt F-U is guided to wrap the upper drums 33 and 34 by upper guide rolls 39 and 40 which are positioned beneath the upper drums 33 and 34. Each of the guide rolls are constructed as hollow roll shells, as illustrated in FIGS. 3 and 4, and each are provided with glands therein so that the web is subjected to a vacuum on the onrunning side of the guide roll and to a pressure on the offrunning side.

As the web is carried over the drum 35 and up over the guide roll 37, it is first subjected to a vacuum which aids in the flow of air out of a zone or pocket 35*a* into the guide roll. On the offrunning side, a pressure is directed out through the lower felt to aid in the transfer of the web onto the upper felt F-U. The guide roll 37 has a first portion 37*a* which is subjected to a vacuum and a second portion 37*b* which is subjected to a pressure. Thus, with the same construction, a vacuum is used in the arrangement of FIG. 1 for the transfer of the web, and a pressure is used in the arrangement of FIG. 2 for the transfer of the web. In both arrangements, the vacuum and pressure are utilized to carry air from or to the zone between the guide roll and dryer drum to aid in carrying away moisture in the zone.

As the web is carried by the upper felt, following the guide roll 37, it is carried over the upper dryer drum 33 and then down over the guide roll 39 where it is first subject to a vacuum from the section 39*a* of the guide roll and then is subjected to a transfer pressure from the section 39*b* of the guide roll. The web is then carried by the lower felt F-L over the lower dryer drum 36 and up over the guide roll 38 where it is transferred to the upper felt to be carried over the upper drum 34. Following this, the web passes down over a guide roll 40 where it is transferred to a second lower felt F-L2 which is threaded up over a roll 42 to wrap the outer surface of the web on the guide 40. The web then is carried by the lower felt F-L2 over a further lower dryer drum 41.

The arrangement above described can be repeated throughout the section of the dryer for as many dryer drums as is necessary to attain a drying of the web.

It will be noted that in the arrangement of FIG. 1, the web is threaded so that it wraps the lower portion of the upper dryer drums on the oncoming side, and wraps the upper portion of the lower drums on the oncoming side.

In the arrangement of FIG. 2, the web wraps the upper portion of the lower drums on the offrunning side and similarly wraps the lower portion of the upper drums on the offrunning side, and this effect is achieved by the arrangement of the felts relative to the guide rolls. Thus, with a given construction, the mechanism can be arranged to attain the advantages of either subjecting the web first to a vacuum and then to a pressure or in the opposite arrangement, first to a pressure and then to a vacuum. In the first arrangement, the vacuum is used for the web transfer, and in the second arrangement, the pressure is used for the web transfer. Various operating conditions and various types of paper will dictate which arrangement is most advantageous. Thus, it will be seen that I have provided an improved dryer arrangement which meets the objectives and advantages above set forth and which enables better and more uniform drying in higher speed papermaking machines.

I claim as my invention:

1. A web dryer for the thermal removal of moisture from a traveling web comprising in combination a plurality of rotatably mounted upper dryer drums adapted to be heated to carry a web and evaporate moisture therefrom;

a plurality of rotatably mounted lower dryer drums adapted to be heated to carry the web and evaporate moisture therefrom; said drums positioned to carry the web in a sinuous path passing successively between the upper and lower drums with the web wrapping the upper and lower surfaces of the drums respectively;

upper and lower looped felts formed of a pervious material accommodating the escape of water vapor from the web and wrapping the web on the upper surfaces of the upper and lower drums respectively;

upper and lower felt guide rolls for the upper and lower felts respectively with one guide roll between each pair of adjacent drums for the upper drums and for the lower drums; said lower felt guide rolls positioned to carry the portion of the lower felt between the adjacent lower drums into the spaces between the lower drums;

said upper felt guide rolls positioned to carry the the portions of the upper felt between adjacent upper drums into the spaces between said upper drums;

said guide rolls being formed of perforate roll shells;

glands inside of said roll shells dividing the shells into a first portion exposed to the oncoming web and a second portion exposed to the offrunning web;

pressure means connected to one of said portions of said glands; and vacuum means connected to the other of said portions of said glands so that the web is subjected to pressure and vacuum in its travel across the guide roll and the spaces between the drums and the guide rolls are subjected to pressure and vacuum.

2. A web dryer for the thermal removal of moisture from a traveling web constructed in accordance with claim 1:

wherein the guide roll and pressure and vacuum means are constructed so that the first portion is subjected to a vacuum and said second portion is subjected to a pressure.

3. A web dryer for the thermal removal of moisture from a traveling web constructed in accordance with claim 1:

wherein the guide roll and pressure and vacuum means are constructed so that the first portion is subjected to a pressure and said second portion is subjected to a vacuum.

4. A web dryer for the thermal removal of moisture from a traveling web comprising in combination:

a plurality of rotatably mounted upper dryer drums adapted to be heated to carry a web and evaporate moisture therefrom;

a plurality of rotatably mounted lower dryer drums adapted to be heated to carry the web and evaporate moisture therefrom;

said drums positioned to carry the web in a sinous path passing successively between the upper and lower durms with the web wrapping the upper and lower surfaces of the drums respectively;

upper and lower looped felts formed of a pervious material accommodating the escape of water vapor from the web and wrapping the web on the upper and lower surfaces of the upper and lower drums respectively;

upper and lower felt guide rolls for the upper and lower felts respectively for guiding the felts from one roll to the next and positioned so that the web transfers from one felt to the other in travel from the upper dryer drums to the lower dryer drums and back to the upper dryer drums; said guide rolls having glands therein dividing the rolls to a first portion facing the oncoming web as it is wrapped over the guide roll and a second portion facing the web on the offrunning side of the guide roll;

pressure means connected to one portion of said gland; and vacuum means connected to the other portion of the glands of each of the guide rolls so that the zone facing the web on one side of the guide roll is subjected to pressure and the zone on the other side of the guide roll is subjected to a vacuum.

5. A web dryer for the thermal removal of moisture from a traveling web constructed in accordance with claim 4:

wherein the portion of the guide roll on the onrunning side is subject to pressure and the portion on the offrunning side is subject to vacuum.

6. A web dryer for the thermal removal of moisture from a traveling web constructed in accordance with claim 4:

wherein the portion on the onrunning side of the guide roll is subjected to vacuum and the portion on the offrunning side is subjected to a pressure.

7. A web dryer for the thermal removal of moisture from a traveling web comprising in combination:

a plurality of rotatably mounted upper dryer drums adapted to be heated to carry a web and evaporate moisture therefrom;

a plurality of rotatably mounted lower dryer drums adapted to be heated to carry the web and evaporate moisture therefrom; said drums positioned to carry the web in a sinuous path passing successively between the upper and lower drums with the web wrapping the upper and lower surfaces respectively;

upper and lower looped felts formed of a pervious material accommodating the escape of water vapor from the web and wrapping the web on the upper and lower surfaces of the upper and lower drums respectively;

upper felt guide rolls for the upper felts with one guide roll positioned beneath each of the upper drums and between adjacent lower drums;

lower felt guide rolls positioned above each of the lower drums and between adjacent upper drums;

means guiding said web over a lower drum and then over an upper felt guide roll and then causing it to wrap an upper drum and then travel over a lower felt guide roll;

said guide rolls being hollow perforate roll shells with glands therein dividing the interior of the shell into a first portion facing the onrunning web and a second portion facing the offrunning web;

vacuum means subjecting one of said portions to a vacuum; and pressure means subjecting the other of said portions of each of the guide rolls to a pressure whereby the zone opposite the pressure means outside of the guide roll is pressuized in the zone opposite the vacuum means outside of the guide roll subjected to a vacuum.

8. A web dryer for the thermal removal of moisture from a traveling web comprising in combination:

a plurality of rotatably mounted upper dryer drums adapted to be heated to carry a web and evaporate moisture therefrom;

a plurality of rotatably mounted lower dryer drums adapted to be heated to carry the web and evaporate moisture therefrom;

said drums positioned to carry the web in a sinuous path passing successively between the upper and lower drum with the web wrapping the upper and lower surfaces respectively;

upper and lower looped felts formed of a pervious material accommodating the escape of water vapor from the web and wrapping the web on the upper and lower surfaces of the upper and lower drums respectively;

upper felt guide rolls on the upper felts with one guide roll positioned beneath each of the upper drums and between adjacent lower drums;

lower felt guide rolls positioned above each of the lower drums and between adjacent upper drums;

means guiding the web over a lower drum and then up over an upper turning roll and then up over an upper drum and down over a lower turning roll;

said guide rolls being hollow roll shells;

means dividing the interior of the guide roll shells into a first portion facing the oncoming web and a second portion facing the offrunning web;

vacuum means connected to the guide rolls and subjecting one of said portions to a vacuum; and pressure means subjecting the other of said portions of the guide rolls to a pressure so that the zone opposite the vacuum means outside of the guide roll is subject to a vacuum and the zone outside of the pressure section of the guide rolls is subjected to a pressure.

* * * * *